US009089985B2

(12) United States Patent
Hatakeyama

(10) Patent No.: US 9,089,985 B2
(45) Date of Patent: Jul. 28, 2015

(54) SHEET CUTTING DEVICE

(75) Inventor: Kazuhiko Hatakeyama, Tokyo (JP)

(73) Assignee: SATO HOLDINGS KABUSHIKI KAISHA (JP)

( * ) Notice: Subject to any disclaimer, the term of this patent is extended or adjusted under 35 U.S.C. 154(b) by 164 days.

(21) Appl. No.: 13/995,663

(22) PCT Filed: Jul. 19, 2011

(86) PCT No.: PCT/JP2011/004073

§ 371 (c)(1),
(2), (4) Date: Jun. 19, 2013

(87) PCT Pub. No.: WO2012/090346

PCT Pub. Date: Jul. 5, 2012

(65) Prior Publication Data

US 2013/0276609 A1 Oct. 24, 2013

(30) Foreign Application Priority Data

Dec. 28, 2010 (JP) ..... 2010-291591

(51) Int. Cl.
*B26D 1/00* (2006.01)
*B26D 1/25* (2006.01)
(Continued)

(52) U.S. Cl.
CPC *B26D 1/255* (2013.01); *B26D 1/30* (2013.01); *B26D 1/305* (2013.01); *B26D 5/18* (2013.01);
(Continued)

(58) Field of Classification Search
CPC ..... B26D 2001/0066; B26D 2001/0053; B26D 2007/2685; B26D 5/18; B26D 5/14; B26D 5/086; B26D 5/08; B26D 7/08; B26D 1/255; B26D 1/30; B26D 1/305; B26D 1/065; B26D 1/045
USPC ..... 83/614, 643, 642
See application file for complete search history.

(56) References Cited

U.S. PATENT DOCUMENTS 213,089 A * 3/1879 Beck ..... 83/643
391,268 A * 10/1888 Parker ..... 7/144
(Continued)

FOREIGN PATENT DOCUMENTS

JP 60-97291 7/1985
JP 8-141982 6/1996
(Continued)

OTHER PUBLICATIONS

European Search Report dated May 28, 2014.
(Continued)

*Primary Examiner* — Sean Michalski
(74) *Attorney, Agent, or Firm* — Ostrolenk Faber LLP

(57) ABSTRACT

A sheet feeding device includes a moving mechanism (20) configured to move a cutting edge (Ba) of a movable blade (B) away from a cutting edge (Aa) of a fixed blade A to move the cutting edge (Ba) of the movable blade (B) from an open position (X) where a fed sheet (S) is received and to place the cutting edge (Ba) of the movable blade (Ba) at an open position; a mechanism (35) biases the movable blade (B) toward the fixed blade (A) so that the cutting edge (Ba) of the movable blade (B) slides against the cutting edge (Aa) of the fixed blade (A) a blade spacing mechanism (40) moves the movable blade (B) away from the fixed blade (A) against a biasing force of the biasing mechanism (35) during a allowing the movable blade (B) to reach the open position (X) after cutting of the sheet S with the movable blade (B). The spacing mechanism (40) includes a cam (41) provided on the fixed blade (A) side and a cam follower (42) in contact with the cam (41) provided on the sides of the movable blade (B). This prevents the sheet from being curled up and jammed by being hooked on the movable blade.

7 Claims, 6 Drawing Sheets

(51) Int. Cl.

| | |
|---|---|
| ***B26D 1/30*** | (2006.01) |
| ***B26D 5/18*** | (2006.01) |
| ***B26D 7/08*** | (2006.01) |
| *B26D 1/04* | (2006.01) |
| *B26D 1/06* | (2006.01) |
| *B26D 5/08* | (2006.01) |
| *B26D 7/26* | (2006.01) |
| *B26D 5/14* | (2006.01) |

(52) U.S. Cl.

CPC . *B26D 7/08* (2013.01); *B26D 1/045* (2013.01); *B26D 1/065* (2013.01); *B26D 5/08* (2013.01); *B26D 5/086* (2013.01); *B26D 5/14* (2013.01); *B26D 2001/0053* (2013.01); *B26D 2001/0066* (2013.01); *B26D 2007/2685* (2013.01)

(56) References Cited

U.S. PATENT DOCUMENTS

| | | | | | |
|---|---|---|---|---|---|
| 947,506 | A | * | 1/1910 | Weinbach | 112/128 |
| 2,443,369 | A | * | 6/1948 | Alifano et al. | 112/128 |
| 3,465,632 | A | * | 9/1969 | Bilek | 83/555 |
| 3,580,123 | A | * | 5/1971 | Westra et al. | 83/380 |
| 3,682,029 | A | * | 8/1972 | Haas et al. | 83/69 |
| 3,774,478 | A | * | 11/1973 | Carpenter et al. | 81/9.51 |
| 3,780,610 | A | * | 12/1973 | Zadow | 83/643 |
| 3,800,646 | A | * | 4/1974 | Benz | 83/320 |
| 3,866,503 | A | * | 2/1975 | Gal | 83/626 |
| 4,200,020 | A | * | 4/1980 | Durselen | 83/643 |
| 4,398,441 | A | * | 8/1983 | Jue | 83/575 |
| 4,463,693 | A | * | 8/1984 | Dreier et al. | 112/128 |
| 5,408,908 | A | | 4/1995 | Rosenthal | |
| 5,658,229 | A | * | 8/1997 | Armington et al. | 493/363 |
| 6,032,558 | A | * | 3/2000 | Michler | 83/74 |
| 6,148,708 | A | * | 11/2000 | Pfeiffer | 83/628 |
| 6,408,727 | B1 | | 6/2002 | Harris | |
| 6,732,619 | B2 | * | 5/2004 | Carriere et al. | 83/13 |
| 8,146,472 | B2 | * | 4/2012 | Nishimura et al. | 83/642 |
| 8,166,857 | B2 | * | 5/2012 | Powell et al. | 83/30 |
| 8,539,869 | B2 | * | 9/2013 | Flood et al. | 83/111 |
| 8,621,968 | B1 | * | 1/2014 | Pederson et al. | 83/410.9 |
| 8,764,182 | B2 | * | 7/2014 | Ogawa et al. | 347/104 |
| 2009/0223067 | A1 | * | 9/2009 | Zhang | 30/294 |
| 2013/0118330 | A1 | * | 5/2013 | Sago et al. | 83/596 |
| 2014/0041175 | A1 | * | 2/2014 | Tsai | 29/56.6 |

FOREIGN PATENT DOCUMENTS

| | | |
|---|---|---|
| JP | 08-155884 | 6/1996 |
| JP | 10-315188 | 12/1998 |
| JP | 2002-018773 | 2/2002 |
| JP | 2004-298989 | 10/2004 |
| JP | 2005 111601 | 4/2005 |
| JP | 2005-111601 | 4/2005 |
| JP | 2006-175536 | 7/2006 |
| JP | 2009-101470 | 5/2009 |
| JP | 2010-247251 | 11/2010 |

OTHER PUBLICATIONS

International Search Report and Written Opinion dated Oct. 11, 2011 issued in corresponding International patent application No. PCT/JP2011/004073.

Japanese Notice of Reasons for Refusal, dated Nov. 4, 2014, issued in corresponding.

* cited by examiner

SHEET CUTTING DEVICE

TECHNICAL FIELD

CROSS-REFERENCE TO RELATED APPLICATIONS

The present application is a 35 U.S.C. §§371 national phase conversion of PCT/JP2011/004073, filed Jul. 19, 2011, which claims priority of Japanese Patent Application No. 2010-291591, filed Dec. 28, 2010, the contents of which are incorporated by reference herein. The PCT International Application was published in the Japanese language.

The present invention relates to a sheet cutting device, for example, to be mounted on a printer or the like to cut a sheet, particularly to a sheet cutting device in which a movable blade is moved toward a fixed blade to cut a sheet supplied between the cutting edge of the fixed blade and the cutting edge of the movable blade by a so-called scissors cutting action.

BACKGROUND ART

Generally, for example, as shown in FIG. 7, a printer for printing on label sheet S having one adhesive surface transports the label sheet S to a platen 1, performs printing on the label sheet S supported on the platen 1 using a thermal head 2 during the transportation of the label sheet S, and supplies the printed label sheet S to a mounted sheet cutting device Ta. Subsequently, the sheet cutting device Ta cuts the label sheet S into labels of a predetermined size, and a resulting cut label is then used.

Conventionally, as an example of such a kind of the sheet cutting device, one described in Japanese Unexamined Patent Application Publication No. 2009-101470 (Patent Literature 1) has been known in the art. The sheet cutting device, as shown in FIG. 7, moves a mobile blade 101 toward a fixed blade 100 and slides the cutting edge 101*a* of the mobile blade 101 in a direction between the ends of the blade along the cutting edge 100*a* of the fixed blade 100 to cut a sheet S supplied between the cutting edge 100*a* of the fixed blade 100 and the cutting edge 101*a* of the movable blade 101. In this case, a moving mechanism not shown in FIG. 7 moves the cutting edge 101*a* of the movable blade 101 away from the cutting edge 100*a* of the fixed blade 100 to locate the movable blade 101 at open position X with a space now between the cutting edges and allows the separated blades to receive the sheet S fed between the blades at this open position X. Subsequently, for example, the movable blade 101 is moved to cut the sheet S by scissors cutting action, followed by the movable blade again being located at the open position X. During a period of cutting the sheet with the movable blade 101, the movable blade 101 is biased toward the fixed blade 100 by a spring or the like (not shown) so that the cutting edge 101*a* of the movable blade 101 can reliably slide against the cutting edge 100*a* of the fixed blade 100. In addition, because of improving printing quality or the like by linearly transporting the printed sheet S so that it can be transported along the surface of the thermal head 2 on which heating element is mounted, the fixed blade 100 is located at a lower position with respect to a sheet (S) discharging position of a platen 1 to feed the sheet S obliquely from a position above the cutting edge 100*a* of the fixed blade 100 onto the cutting edge 100*a* of the fixed blade 100. The feeding of sheet S does not depend on a so-called flat pass where the sheet S is fed from a direction perpendicular to the sliding direction of the movable blade 101 with respect to the fixed blade 100. Instead, the sheet S is obliquely fed in the sliding direction of the movable blade 101 with respect to the fixed blade 100.

SUMMARY OF INVENTION

Technical Problem

By the way, in the above conventional sheet cutting device Ta, as illustrated in FIG. 8, the sheet S is fed at the open position X of the movable blade 101 (FIG. 8 (1)), and the movable blade 101 cuts the sheet S (FIGS. 8 (2) and (3)). After that, the cutting edge 101*a* of the movable blade 101 may interfere with the tip edge Sa of a subsequently fed sheet S, when the blade 101 is returning to the open position X, to hook and pull the edge up (FIG. 8 (4)). In this case, when another sheet S is fed for subsequent cutting, there is a problem that the hooked edge may generate sheet buckling and cause jamming (FIG. 8 (5)). In particular, as illustrated in FIG. 7, the sheet is obliquely fed in the direction of the movable blade 101 with respect to the fixed blade 100. After cutting the sheet S, therefore, the tip edge Sa thereof is slightly out over the cutting edge 100*a* of the fixed blade 100, where the sheet there interferes with the moving path of the cutting edge 101*a* of the movable blade 101. The tip edge Sa of the sheet S tends to be hooked on the cutting edge 101*a* and is curled up. Furthermore, an adhesive label sheet S, such as a label sheet having one adhesive surface temporarily adhered to a mount, or a linerless label sheet having one adhesive surface without need for any mount, is more easily curled up due to adhesion of the adhesive on the sheet S to the cutting edge 101*a* of the movable blade 101.

The present invention has been made in consideration of the above problems, and an object thereof is to provide a sheet cutting device configured to prevent a movable blade from interfering with a sheet during movement of the movable blade to an open position after the sheet has been cut with the movable blade, thereby preventing the sheet from being curled up and jammed as a result of being hooked on the movable blade.

Solution to Problem

In order to solve the above problem, the sheet cutting device of the present invention configures a sheet cutting device configured to move a movable blade toward a fixed blade provided on a base plate and then to slide the cutting edge of the movable blade along the cutting edge of the fixed blade to cut a sheet fed between the cutting edge of the fixed blade and the cutting edge of the movable blade. The sheet cutting device includes: a moving mechanism configured to move the cutting edge of the movable blade away from the cutting edge of the fixed blade in a direction across both of the cutting edges to move the cutting edge of the movable blade to an open position where the fed sheet is received between the blades and to place the cutting edge of the movable blade at the open position. A biasing mechanism is configured to bias the movable blade back toward the fixed blade to enable sliding of the cutting edge of the movable blade with respect to the fixed blade. A spacing mechanism configured to move the movable blade away from the fixed blade against a biasing force of the biasing mechanism during a process of allowing the movable blade to reach the open position after cutting of the sheet with the movable blade.

When cutting a sheet, therefore, first the moving mechanism places the movable blade at the open position and receives the sheet by allowing the fed sheet to pass between the cutting edge of the fixed blade and the cutting edge of the moving blade. Subsequently, the moving mechanism moves the moving blade from the open position and then slides the cutting edge of the moving blade along the cutting edge of the fixed blade. The sheet is fed between the cutting edge of the fixed blade and the cutting edge of the movable blade and is then cut by a so-called scissors cutting action. The cutting can be performed smoothly because, during a period of cutting the sheet by the movable blade, the biasing mechanism biases the movable blade toward the fixed blade to make the cutting edge of the movable blade slide against the cutting edge of the fixed blade. After cutting of the sheet with the movable blade, the moving mechanism allows the movable blade to reach the open position. In this process, however, the spacing mechanism moves the movable blade away from the fixed blade against a biasing force of the biasing mechanism during the process.

In this case, since the movable blade is placed away from the fixed blade even when the cutting edge of the movable blade interferes with the tip edge of a subsequently fed sheet, the moving blade is prevented from hooking and pulling up the tip edge of the sheet. In particular, when the sheet is obliquely fed in the sliding direction of the movable blade with respect to the fixed blade, the tip edge of the sheet is slightly out of or even beyond the cutting edge of the fixed blade. However, since the movable blade is placed away from the fixed blade, the tip edge of the sheet does not interfere with the moving path of the cutting edge of the movable blade. Thus the sheet can be prevented from the situation where the tip edge thereof is hooked and curled up. Likewise, even in the case of an adhesive label sheet, the movable blade is placed away from the fixed blade. Thus, the cutting edge of the movable blade is prevented from adhesion of the paste of the sheet, thereby preventing the sheet from the situation where the tip edge thereof is easily hooked and curled up.

As a result, at the open position of the movable blade, when a sheet is fed between the blades for the next cutting, the sheet avoids the situation where the tip edge of the sheet is curled up by being hooked on the cutting edge of the movable blade. Thus, the sheet can completely pass through between the cutting edges and can avoid the situation where sheet buckling and jamming are caused.

Optionally, furthermore, the separating mechanism may include a cam provided on the fixed blade side and a cam follower provided on the movable blade side and configured to contact with the cam. A cam surface of the cam includes a first guide surface for guiding the cam follower to bring the tip edge of the movable blade into sliding contact with the tip edge of the fixed blade, and a second guide surface for pulling up the cam follower against a biasing force of the biasing mechanism when the movable blade reaches the open position after cutting the sheet by the movable blade. Thus, when the moving mechanism moves the movable blade from the open position, the cam guides the cam follower to move it from the second guide surface to the first guide surface. On the first guide surface, the guiding is performed so that the cutting edge of the movable blade can be brought into sliding contact with the cutting edge of the fixed blade. Therefore, the sheet can be reliably cut with the movable blade. After cutting of the sheet, the movable blade reaches the open position. In this process, the cam follower is guided by the cam to move from the first guide surface to the second guide, followed by being pulled up against a biasing force of the biasing mechanism to move the movable blade away from the fixed blade. In this case, since the movable blade is moved by the cam and the cam follower, such a movement can be reliably performed by a simple mechanism.

In this case, it is effective to configure the cam follower using a rolling element that rolls on the cam surface of the cam. The rolling element provided as a cam follower rolls on the cam surface while following the movement of the moving blade. Thus the cam follower moves smoothly.

Where applicable, the moving mechanism may include: a first link provided on one end side of the fixed blade so as to be swingable around an axis in a direction perpendicular to a direction along the cutting edge of the fixed blade and configured to support one end portion of the movable blade; and a second link provided on the other end side of the fixed blade so as to be swingable around an axis in a direction perpendicular to a direction along the cutting edge of the fixed blade and configured to support the other end portion of the movable blade. A rotation shaft with an axis in a direction along the cutting edge of the movable blade is provided on each of the end portions of the movable blade. The rotation shafts are pivotably supported on their corresponding first and second links. The biasing mechanism includes, in a least one of the first and second links, a spring placed between the movable blade and the corresponding link and configured to bias the movable blade toward the fixed blade.

A so-called scissors cutting action of the movable blade with respect to the fixed blade can be reliably performed, while the spacing mechanism can reliably place the movable blade away from the fixed blade.

Advantageous Effects of Invention

According to the present invention, after cutting a sheet with a movable blade, in a process of allowing the movable blade to reach an open position, a spacing mechanism moves the movable blade away from a fixed blade against a biasing force of a biasing mechanism. The movable blade can be therefore prevented from interfering with the tip edge of the next sheet, and thus from hooking and pulling up the tip edge of this sheet. In particular, when the sheet is obliquely fed in the sliding direction of the movable blade with respect to the fixed blade, the tip edge of the sheet is slightly out of or beyond the cutting edge of the fixed blade. However, since the movable blade is placed away from the fixed blade, the tip edge of the sheet does not interfere with the moving path of the cutting edge of the movable blade. Thus the sheet can be prevented from the situation where the tip edge thereof is hooked and curled up. Likewise, in particular, in the case of an adhesive label sheet, such as a label sheet having one adhesive surface temporarily adhered to a mount or a linerless label sheet having one adhesive surface without need for any mount, the movable blade is placed away from the fixed blade. Thus, the cutting edge of the movable blade is prevented from adhesion caused by the paste of the sheet, thereby preventing the sheet from the situation where the tip edge thereof is easily hooked and curled up. As a result, at the open position of the movable blade, when a sheet is fed for the next cutting, the sheet can be prevented from the situation where sheet buckling and jamming are caused.

DESCRIPTION OF EMBODIMENTS

Figure 1:
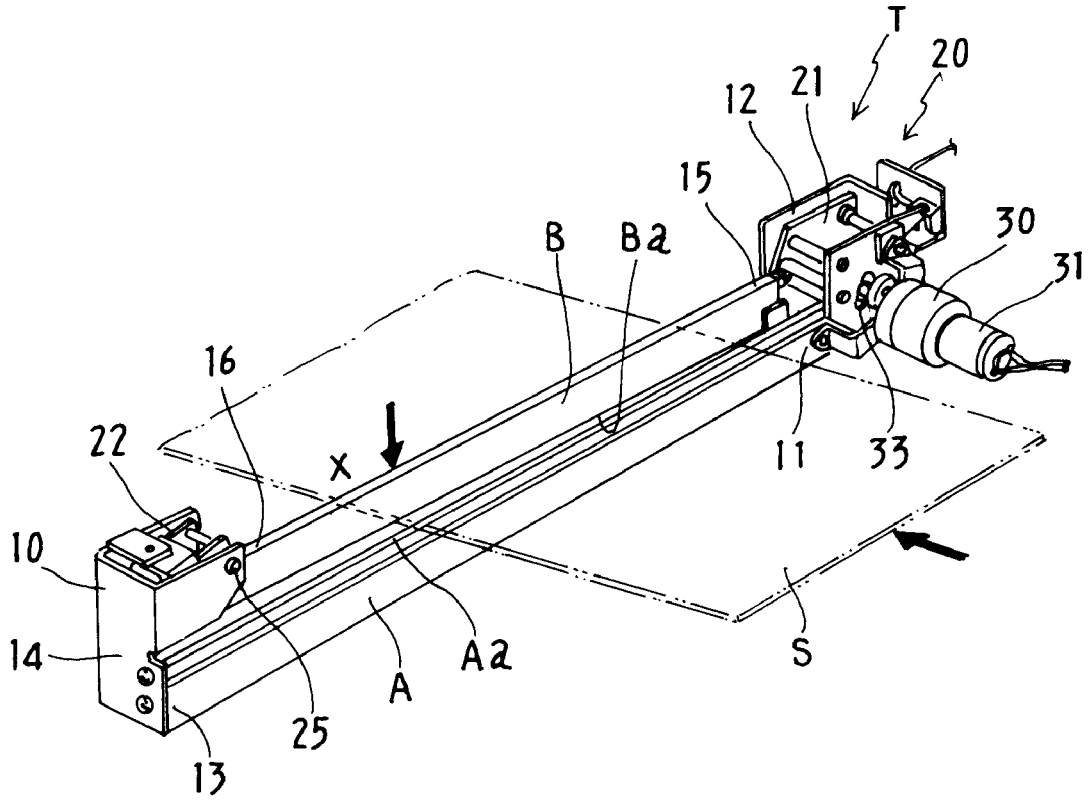
FIG. 1 is an entire perspective view illustrating the sheet cutting device according to an embodiment of the invention.

Hereafter, the sheet cutting device according to an embodiment of the present invention will be described in detail with reference to the attached drawings. In the following description, the same reference numerals will be given to the same components as those in the above description.

Figure 3:
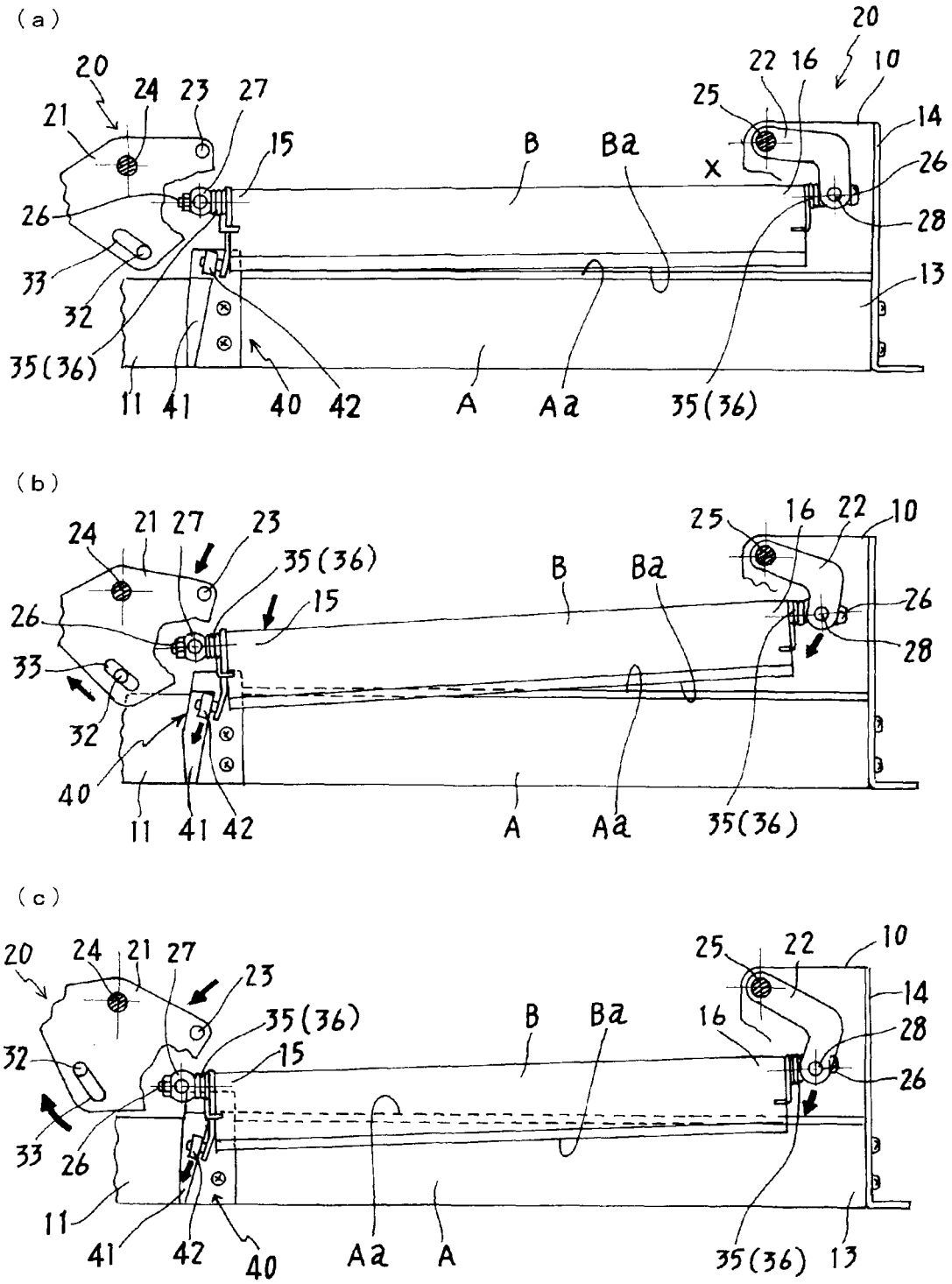
FIG. 3 is a diagram illustrating movement of a movable blade of the sheet cutting device according to the embodiment of the invention.
Figure 4:
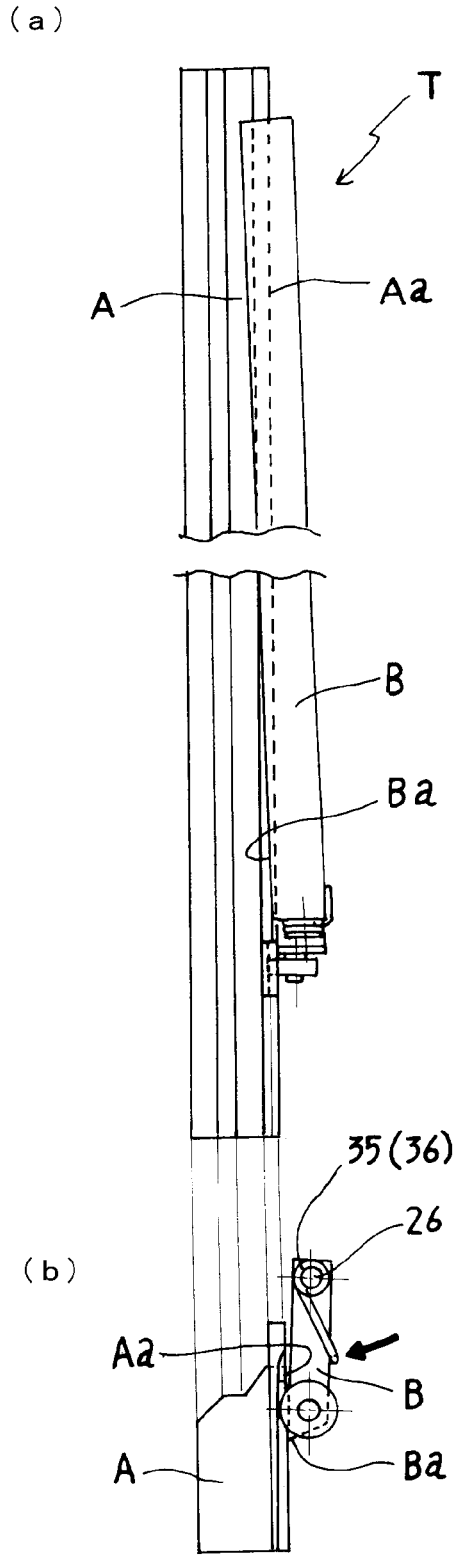
FIG. 4 is a diagram illustrating a relationship between a fixed blade and the movable blade of the sheet cutting device according to the embodiment of the present invention, where (a) is a plan view and (b) is a side view.
Figure 5:
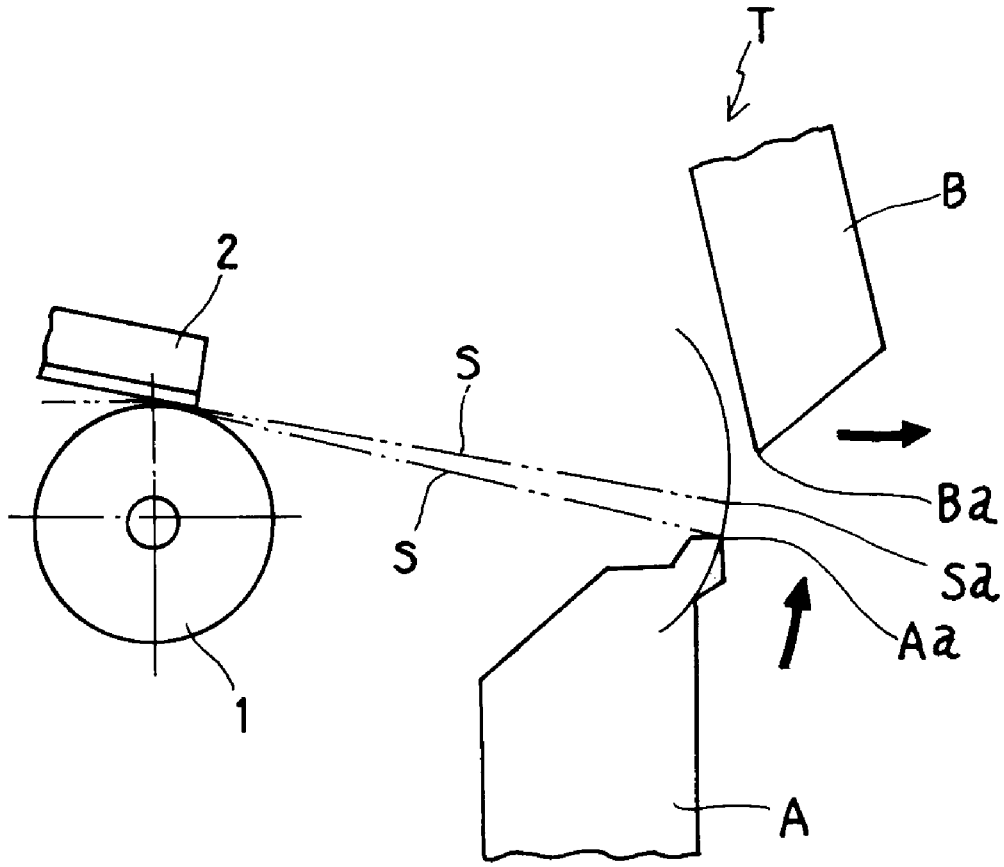
FIG. 5 is a diagram illustrating the sheet cutting device according to the embodiment of the present invention and a main part of a printer on which such a device is mounted, and illustrating a relationship between a sheet and the movable blade.

A sheet cutting device T according to an embodiment illustrated in FIG. 1 to FIG. 6 is mounted on a printer configured to perform printing on a label sheet S having one adhesive surface. As illustrated in FIG. 5, the printer transports the label sheet S and employs its thermal head 2 to perform printing on the label sheet S supported by a platen 1 in the transporting process. This printed label paper S is supplied to sheet cutting device T, it cuts a label in a necessary size in this sheet cutting device T, and this cut label is used.

Figure 2:
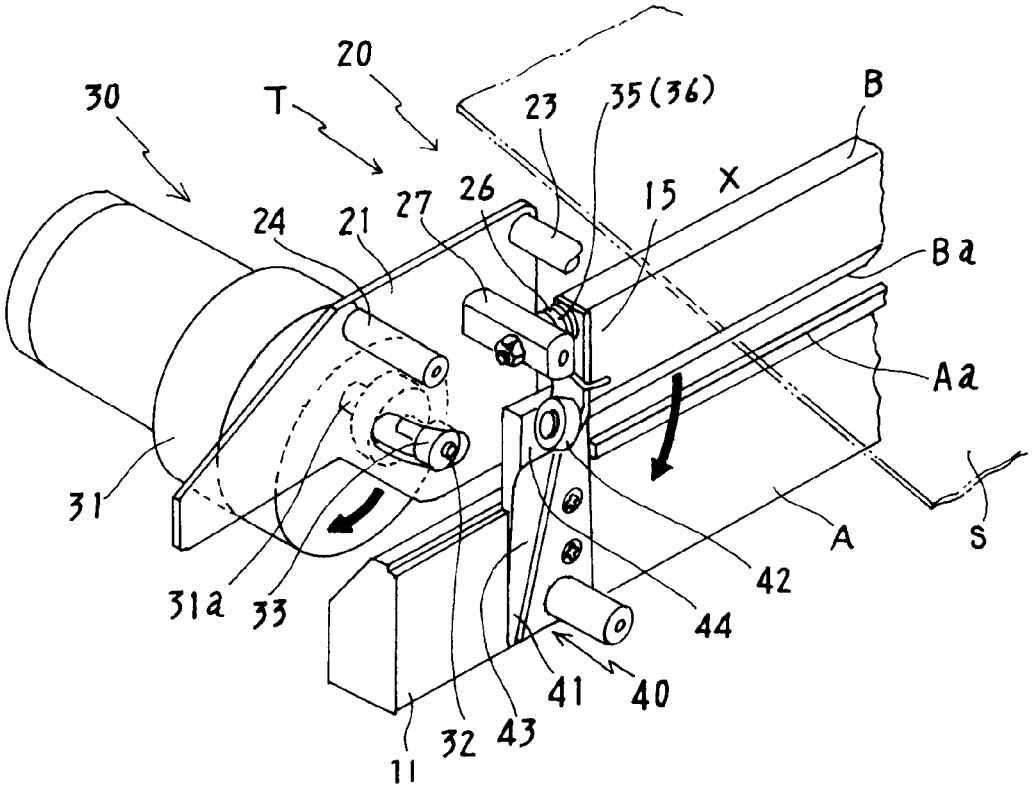
FIG. 2 is a perspective view illustrating the main part of the sheet cutting device according to the embodiment of the invention.

The sheet cutting device according to the embodiment of the invention includes, as illustrated in FIG. 1 and FIG. 2, a base plate 10, a plate-shaped fixed blade A provided on the base plate 10, and a plate-shaped movable blade B provided on the base plate 10. The movable blade B is allowed to move toward a fixed blade A and slide along the cutting edge Aa of the fixed blade A to cut a sheet S fed between the cutting edge Ba of the fixed blade B and the cutting edge Ba of the movable blade B. One end 11 of the fixed blade A is fixed at an under side of a bracket 12 on one side of the base plate 10, and the other end 13 of the fixed blade A is fixed at an under side of a bracket 14 on the other side of the base plate 10. As illustrated in FIG. 5, furthermore, the fixed blade A is located at a position below a sheet S-discharging position of the platen 1 so that the sheet S can be obliquely fed from a position above the cutting edge Aa of the fixed blade A onto the cutting edge Aa of the fixed blade A. The feeding of sheet S does not depend on a so-called flat pass where the sheet S is fed from a direction perpendicular to the sliding direction of the movable blade B with respect to the fixed blade A. In steed, the sheet S is obliquely fed in the sliding direction of the movable blade B with respect to the fixed blade A.

The sheet cutting device T according to the present invention includes, as illustrated in FIG. 1 to FIG. 3, a moving mechanism 20 configured to move the cutting edge Ba of the movable blade B away from the cutting edge Aa of the fixed blade A to move the cutting edge Ba of the movable blade B from an open position X (FIG. 3 (*a*)) where the fed sheet S is received and to place the cutting edge Ba of the movable blade Ba at the open position again. The moving mechanism 20 includes a first link 21 for supporting one end portion 15 of the movable blade B and a second link 22 for supporting the other end portion 16 of the movable blade B. The first link 21 is a member having two plates connected by a plurality of connection rods 23. The first link 21 is provided on the upper side of the bracket 12 on one end of the base plate 10 on one end 11 side of the fixed blade A and configured to be swingable around an axis 24 extending in a direction perpendicular to a direction along the cutting edge Aa of the fixed blade A. The second link 22 is a member having two L-shaped members that are connected to each other through a support shaft 28 described later. The second link 22 is provided on the upper side of the bracket 14 on the other end of the base plate 10 on the other end 13 side of the fixed blade A and configured to be swingable around an axis 25 in a direction perpendicular to the direction along the cutting edge Aa of the fixed blade A.

In the moving mechanism 20, furthermore, a rotation shaft 26 with an axis in a direction along the cutting edge Ba of the movable blade B is provided on each of the end portions 15 and 16 of the movable blade B. The rotation shafts 26 are pivotably supported on their corresponding first link 21 and second link 22. The rotation shaft 26 on one end portion 15 side of the movable blade B is pivotally supported by a support shaft 27 disposed between two plates of the first link 21. The support shaft 27 is provided on the first link 21 so that it can rotate around an axis perpendicular to a direction along the cutting edge Aa of the fixed blade A. A rotation shaft 26 on the other end portion 16 side of the movable blade B is pivotally supported by a support shaft 28 disposed between two plates of the second link 22. The support shaft 28 is provided on the second link 22 so that it can rotate around an axis perpendicular to a direction along the cutting edge Aa of the fixed blade A.

Furthermore, the moving mechanism 20 includes a driving part 30 that allows at least one of the first link 21 and the second link 22 (in this embodiment, the first link 21) to be swingably driven. As illustrated in FIG. 1 and FIG. 2, the driving part 30 includes an electric motor 31 where the one side bracket 12 is provided on the outside thereof. The rotation shaft 31*a* of the electric motor 31 is provided with an eccentric shaft 32 that revolves around the rotation shaft 31*a*. The eccentric shaft 32 is engaged with a crank slot 33 formed in one of the plates of the first link 21. The first link 21 is swung through the crank slot 33 via the eccentric shaft 32 by rotation of the rotation shaft 31*a* of the electric motor 31. As illustrated in FIG. 3, the second link 22 is also swung by the swing of the first link 21 via the movable blade B. By swinging the first link 21 and the second link 22, the movable blade B is allowed to move from the open position X and perform a so-called scissors cutting action, followed by being placed at the open position X. In other words, the movable blade B performs a circulation movement along a predetermined track. When the cutting edge Ba of the movable blade B slides along the cutting age Aa of the fixed blade A, as illustrated in FIG. 4 (*a*), the cutting edge Ba of the movable blade B is moved so that it can intersect the cutting edge Aa of the fixed blade A at a point.

Figure 6:
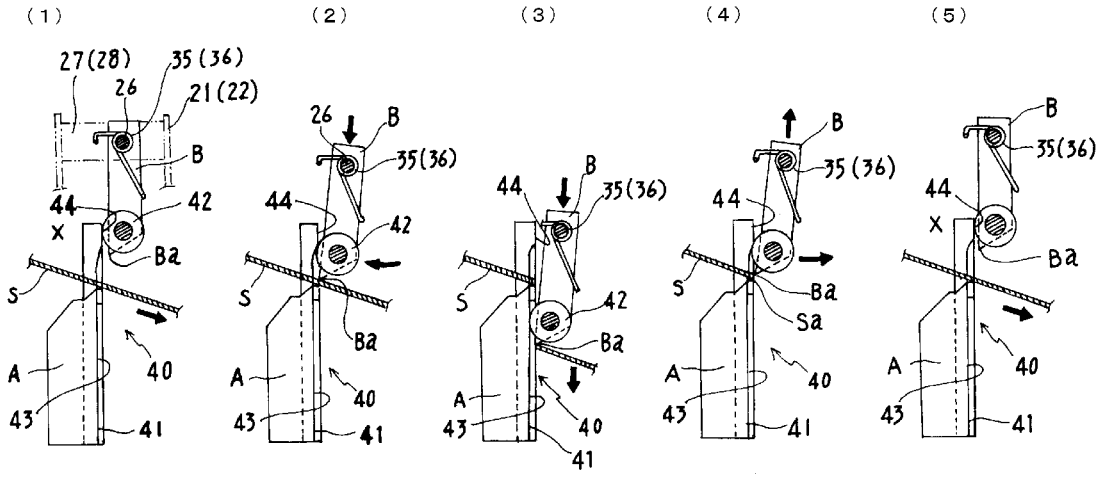
FIG. 6 is a diagram illustrating working of the sheet cutting device according to the embodiment of the present invention.
Figure 7:
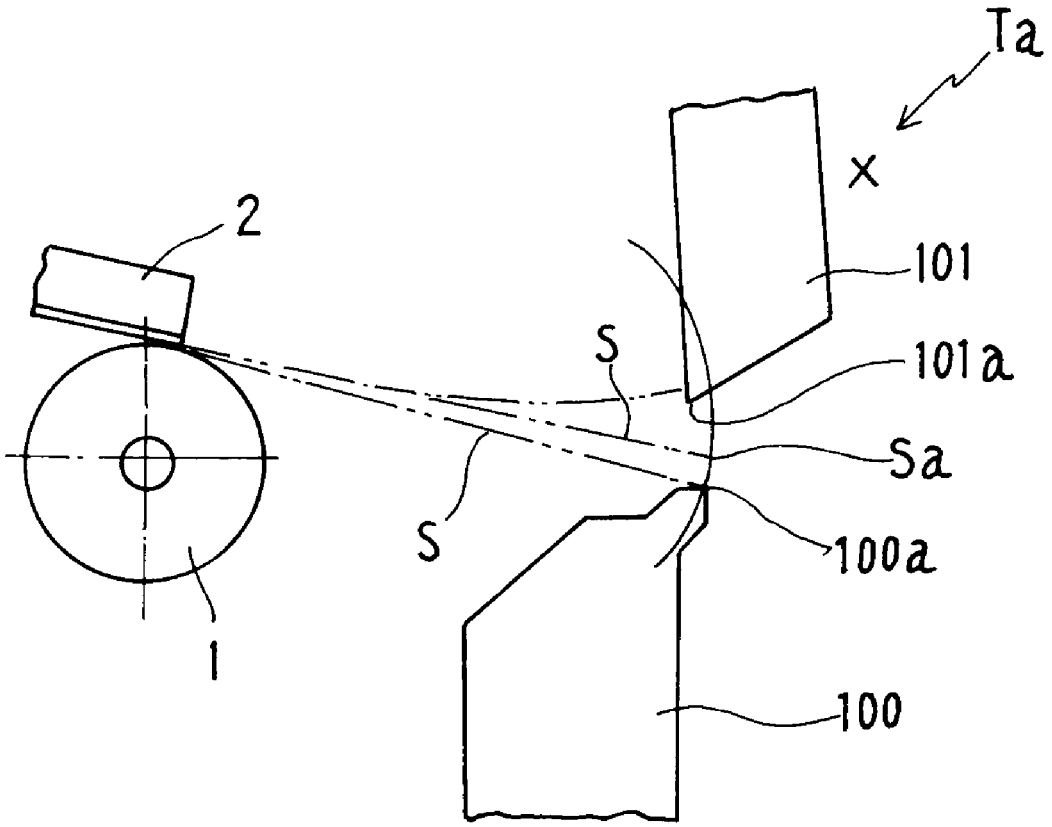
FIG. 7 is a diagram illustrating the conventional sheet cutting device and a main part of a printer on which such a device is mounted, and illustrating a relationship between a sheet and the movable blade.
Figure 8:
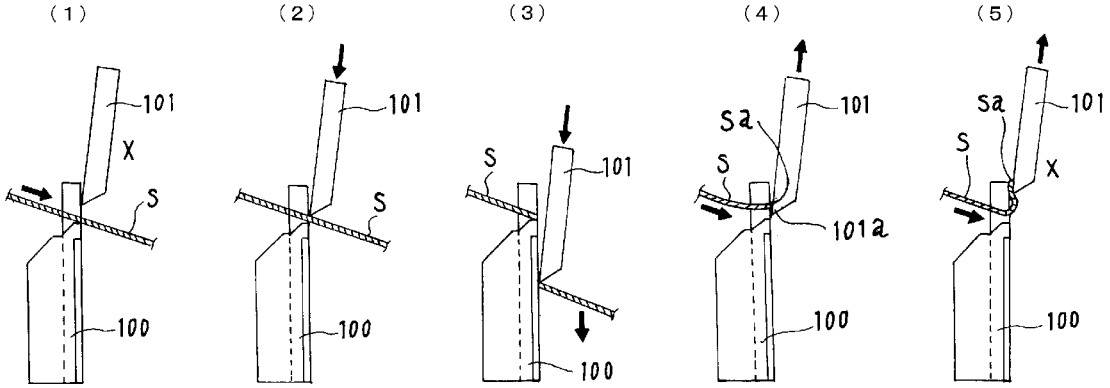
FIG. 8 is a diagram illustrating working of the conventional sheet cutting device and problems thereof.

Furthermore, the sheet cutting device T of the embodiment includes a biasing mechanism 35 that biases the movable blade B toward the fixed blade A so that the cutting edge Ba of the movable blade B can slide against the cutting edge Aa of the fixed blade A. In at least one of the first link 21 and the second link 22 (both in the embodiment), a biasing mechanism 35 is provided between the movable blade B and the corresponding link 21 or 22. The biasing mechanism 35 includes a coil spring 36 that biases the movable blade toward the fixed blade A. As illustrated in FIG. 3, FIG. 4, and FIG. 6, the coiling spring 36 is inserted into the rotation shaft 26, and one end of the coiling spring 36 is engaged in the link 21 or 22 and the other end thereof in the movable blade B.

Furthermore, as illustrated in FIG. 2, FIG. 3, and FIG. 6, the sheet cutting device T according to the embodiment of the invention includes a spacing mechanism 40 configured to move the movable blade B away from the fixed blade against a biasing force of the biasing mechanism 35 in a process of allowing the movable blade B to reach the open position X after cutting the sheet S by the movable blade B. The spacing mechanism 40 includes a cam 41 provided on a surface on the one end 11 side of the fixed blade A, but opposite to the electric motor 31, and a cam follower 42 in contact with the came 41 provided on one end of the movable blade B. The cam follower 42 includes a roller as a rolling element configured to roll on the cam surface of the cam 41 and to be pivotally supported by an axis in a direction along the cutting edge Ba of the movable blade B.

The cam surface of the cam 41 is of an oblong shape. The cam surface includes a first guide surface 43 for guiding the cam follower 42 to bring the tip edge Ba of the movable blade B into sliding contact with the tip edge Aa of the fixed blade A and a second guide surface 44 for pulling up the cam follower 42 against a biasing force of the biasing mechanism 35 when the movable blade B reaches the open position X after cutting the sheet S by the movable blade B.

A label sheet S is therefore fed when preparing a label with the printer on which the sheet cutting device T according to the present embodiment is mounted. First, as illustrated in FIG. 5, printing is performed on the platen 1 with the thermal head 2. Subsequently, the sheet S is discharged from the platen 1 and then obliquely fed from a position above the cutting edge Aa of the fixed blade A in the sheet cutting device T onto the fixed blade A.

The sheet cutting device T receives the sheet S such that the moving mechanism 20 places the movable blade B at the open position X and passes the fed sheet S through between the cutting edge Aa of the fixed blade A and the cutting age Ba of the movable blade B (FIG. 6 (1)). Subsequently, the moving mechanism 20 moves the moving blade B from the open position X and slides the cutting edge Ba of the moving blade B along the cutting edge Aa of the fixed blade A. The sheet, which is fed between the cutting edge Aa of the fixed blade A and the cutting edge Ba of the movable blade B, is then cut by a so-called scissors cutting action (FIGS. 6 (2) and (3)). The cutting can be performed smoothly because, during a period of cutting the sheet S by the movable blade B, the biasing mechanism 35 biases the movable blade B toward the fixed blade A to make the cutting edge Ba of the movable blade B slide against the cutting edge Aa of the fixed blade A. Thus, when the moving mechanism 20 moves the movable blade B from the open position X, the cam 41 guides the cam follower 42 to move it from the second guide surface 44 to the first guide surface 43. On the first guide surface 43, the guiding is performed so that the cutting edge Ba of the movable blade B can be brought into sliding contact with the cutting edge Aa of the fixed blade A. Therefore, the sheet S can be reliably cut with the movable blade B. The label cut in this sheet cutting device T can be used suitably.

After cutting the sheet S with the movable blade B, the moving mechanism 20 allows the movable blade B to reach the open position X. In this process (FIG. 6 (4)), however, the spacing mechanism 40 moves the movable blade 20 away from the fixed blade A against a biasing force of the biasing mechanism 35 during the process. In other words, in the process where the movable blade B reaches the open position X, the cam follower 42 is guided by the cam 41 to move from the first guide surface 43 to the second guide 44, followed by being pulled up against a biasing force of the biasing mechanism 35 to move the movable blade B away from the fixed blade A. In this case, since the movable blade B is moved by the cam 41 and the cam follower 42, such a movement can be reliably performed by a simple mechanism.

In this case, as illustrated in FIG. 5 and FIG. 6 (5), since the movable blade B is placed away from the fixed blade A, even when the cutting edge Ba of the movable blade B interferes with the tip edge of a subsequently fed sheet S, the moving blade is prevented from hooking and pulling up the tip edge of the sheet S. In particular, when the sheet S is obliquely fed across the sliding direction of the movable blade B with respect to the fixed blade A, the tip edge of the sheet S is slightly out from the cutting edge Aa of the fixed blade A. However, since the movable blade B is placed away from the fixed blade A, the tip edge of the sheet S does not interfere with the moving path of the cutting edge Ba of the movable blade B. Thus, the situation where the tip edge of the sheet is hooked and curled up can be prevented. Likewise, even in the case of an adhesive label sheet S, the movable blade B is placed away from the fixed blade A. Thus, the cutting edge Ba of the movable blade B is prevented from adhesion with the paste of the sheet S, thereby preventing the tip edge of the sheet S being easily hooked and curled up.

Again, at the open position X of the movable blade B, the next sheet S fed from the platen 1 side is received by passing between the cutting edge Aa of the fixed blade A and the cutting edge Ba of the movable blade B (FIG. 6 (5)). In this case, the sheet S is prevented from the situation where the tip edge of the sheet is curled up by being hooked on the cutting edge Ba of the movable blade B. Thus, the sheet S can completely pass through between the cutting edges and can be prevented from the situation where sheet buckling and jamming are caused.

Although the above embodiment has been described where the present device is mounted on the printer configured to perform printing on the label sheet S having one adhesive surface, it is not construed as being limited thereto. The device may be mounted on another type of printer, which may perform printing on a sheet S such as recording paper. Alternatively, it goes without saying that the sheet cutting device T may be mounted on various kinds of devices that handle sheets S or may be solely used, or may be suitably modified.

The invention claimed is:

1. A sheet cutting device configured to move a second blade toward or away from a first blade and to slide a cutting edge of the second blade along a cutting edge of the first blade to cut a sheet that is fed between the cutting edge of the first blade and the cutting edge of the second blade, the sheet cutting device comprising:

a first blade having a first cutting edge;

a second blade relatively movable toward and away from the first blade, the second blade having a second cutting edge which opposes the first cutting edge for cutting a sheet when the second blade is moved from an open position away from the first blade and toward the first blade;

a slide device connected with the second blade and configured and operable to slide the cutting edge of the second blade along the cutting edge of the first blade for causing the cutting edges to intersect to cut a sheet that is fed between the first and second cutting edges;

a blade moving mechanism connected with the second blade and configured and operable to move the second cutting edge of the second blade away from and apart from the first cutting edge of the first blade to move the cutting edges to an open position at which the blades are spaced apart across a direction of the length of the blades for providing space for the sheet to be fed between the cutting edges, and the moving mechanism is also configured and operable to move the second blade to the first blade defining a closed position at which the cutting edges slide along each other for cutting the sheet;

a biasing mechanism connected with the second blade and configured to bias the second blade toward the first blade and during the sheet cutting, to cause the second cutting edge of the second blade to slide with respect to the first cutting edge of the first blade for cutting for causing a sheet to be cut between the first and second cutting edges; and a spacing mechanism connected with the second blade and configured and operable to move the second blade away from the first blade against the biasing force of the biasing mechanism during movement of the second blade to the open position.

2. The sheet cutting device of claim 1, further comprising a base on which the first blade is supported so that the first blade is fixed, and the moving, biasing and spacing mechanisms are so connected with the second blade and so configured for moving and for sliding the second blade which is a movable blade.

3. The sheet cutting device of claim 1, wherein the separating mechanism comprises:

the first blade having a side surface which is below the first cutting edge, the spacing mechanism includes a cam on the side surface of the first blade, the cam including a first guide surface extending below the first cutting edge;

the second blade having a second side surface below the second cutting edge and a cam follower on the second side surface shaped, positioned and configured for contacting the cam;

the first guide surface of the cam being shaped for guiding the cam follower for bringing the cutting edge of the second blade into sliding contact with the cutting edge of the first blade so that the first and second cutting edges may act together to cut the sheet; and a second guide surface on the cam configured and operable for pulling the cam follower against the biasing force of the biasing mechanism when the second blade reaches the open position thereof after cutting the sheet.

4. The sheet cutting device of claim 3, wherein the cam follower includes a rolling element thereof located and configured to roll on the first and the second cam surfaces of the cam.

5. The sheet cutting device of claim 1, further comprising:

the first blade having opposite first and second end regions;

the second blade having opposite third and fourth end regions;

a first link provided toward the first end region of the first blade, the first link is supported to be swingable around a first axis extending in a direction perpendicular to a direction along the first blade, and the first link supporting the third end region of the second blade;

a second link toward the second end region of the first blade, the second link being swingable around a second axis extending in a direction perpendicular to the direction along the first blade and the second link supporting the fourth end region of the second blade;

a respective rotation shaft having an axis extending in a direction along the second blade and at each of the third and fourth end regions of the second blade, each rotation shaft is pivotally supported on a respective one of the first and second links;

a link drive operably connected to at least one of the first and second links for swingably driving the at least one of the first and second links around the respective one of the first and second link axes;

the biasing mechanism is included in at least one of the first and second links; and a spring operably connected between the second blade and a corresponding one of the links and configured and operable to bias the second blade toward the first blade.

6. The sheet cutting device of claim 5, further comprising a base on which the first blade is supported so that the first blade is fixed, and the moving, biasing and spacing mechanisms are connected with the second blade for moving the second blade which is a movable blade.

7. The sheet cutting device of claim 2, further comprising:

the blades being positioned with respect to each other such that the second cutting edge is down facing and the first cutting edge is up facing and such that in the open position, the second blade is moved away from the first blade in the feed direction of the sheet; and an arrangement for supporting the sheet to move in a feed direction and between the cutting edges when the edges are in the open position, the sheet supporting arrangement being configured such that the sheet moves between the cutting edges then in the open position with the sheet at a downward oblique orientation to pass spaced away from the second blade.

* * * * *